US007825315B1

(12) United States Patent
King

(10) Patent No.: US 7,825,315 B1
(45) Date of Patent: Nov. 2, 2010

(54) PICK FOR PLAYING MUSICAL INSTRUMENTS AND METHOD OF USING THE PICK

(76) Inventor: Ron King, 4310 Whispering Oaks Cir., Granite Bay, CA (US) 95746

( * ) Notice: Subject to any disclaimer, the term of this patent is extended or adjusted under 35 U.S.C. 154(b) by 0 days.

(21) Appl. No.: 12/286,414

(22) Filed: Sep. 30, 2008

(51) Int. Cl.
*G10D 3/16* (2006.01)

(52) U.S. Cl. ..... 84/322; 84/320; D17/20

(58) Field of Classification Search ..... 84/320, 84/322

See application file for complete search history.

(56) References Cited

U.S. PATENT DOCUMENTS

| | | | | | |
|---|---|---|---|---|---|
| 567,447 | A | * | 9/1896 | Barrientos | 84/291 |
| 768,241 | A | * | 8/1904 | Seidel | 84/322 |
| 2,459,274 | A | | 1/1949 | Galetzky | |
| 2,484,820 | A | * | 10/1949 | Galetzky | 84/322 |
| 3,304,826 | A | * | 2/1967 | Caron | 84/322 |
| 3,319,505 | A | * | 5/1967 | Galetzky | 84/322 |
| D260,529 | S | * | 9/1981 | Pearse | D17/20 |
| D310,233 | S | * | 8/1990 | Farnell, Jr. | D17/20 |
| 4,993,301 | A | | 2/1991 | de los Santos | |
| D317,617 | S | * | 6/1991 | Mutti | D17/20 |
| 5,261,307 | A | * | 11/1993 | Domanski | 84/322 |
| D356,593 | S | | 3/1995 | Purcell | |
| D358,833 | S | | 5/1995 | Ridley et al. | |
| D369,615 | S | | 5/1996 | Latteri | |
| D395,330 | S | | 6/1998 | Sarno | |
| 6,133,516 | A | | 10/2000 | Hendrickson | |
| D444,167 | S | * | 6/2001 | Charters | D17/20 |
| D448,400 | S | | 9/2001 | Freeman | |
| D454,149 | S | | 3/2002 | Freeman | |
| 6,777,602 | B2 | * | 8/2004 | Hautamaki et al. | 84/322 |
| 6,891,095 | B2 | * | 5/2005 | Charters | 84/320 |
| 2005/0204893 | A1 | * | 9/2005 | Luschniu | 84/322 |
| 2005/0223872 | A1 | | 10/2005 | Greenwald | |
| 2007/0256533 | A1 | | 11/2007 | Newmaster | |
| 2008/0178725 | A1 | * | 7/2008 | Goad | 84/320 |
| 2009/0084244 | A1 | * | 4/2009 | Goad | 84/320 |

OTHER PUBLICATIONS

Stash Picks Wicked Pick Guitar Picks, viewed at http://www.samash.com/p/Wicked-Pick-Guitar-Picks-Bag-of-7_-49973774 on Feb. 13, 2010.*

* cited by examiner

*Primary Examiner*—Jeffrey Donels
*Assistant Examiner*—Robert W Horn
(74) *Attorney, Agent, or Firm*—Thomas R. Lampe

(57) ABSTRACT

A hand-held pick for playing guitars and other musical instruments includes a pick body and a plurality of string engaging protrusions. The pick body is flexible and may be used in either a straight condition or a bent condition. The protrusions can be simultaneously engaged with a plurality of strings and simultaneously pluck the strings.

8 Claims, 3 Drawing Sheets

PICK FOR PLAYING MUSICAL INSTRUMENTS AND METHOD OF USING THE PICK

TECHNICAL FIELD

This invention relates to a hand-held pick for playing guitars and other musical instruments having a plurality of strings. The invention also encompasses a method of playing a guitar or other musical instrument having a plurality of strings by utilizing the hand-held pick to pluck the strings.

BACKGROUND OF THE INVENTION

Picks are well known devices for plucking the strings of guitars and other musical instruments, picks typically being utilized to engage and pluck strings individually and sequentially during play. A wide variety of picks of various shapes and sizes are well known, ranging from the standard pear-shaped pick to other more exotic picks or plectrums exemplified by the following prior art: U.S. Pat. No. 6,133,516, issued Oct. 17, 2000, U.S. Pat. No. 5,261,307, issued Nov. 16, 1993, U.S. Pat. No. 4,993,301, issued Feb. 19, 1991, U.S. Pat. No. 2,484,820, issued Oct. 18, 1949, U.S. Pat. No. 2,459,274, issued Jan. 18, 1949, U.S. Patent Application Pub. No. US 2007/0256533, published Nov. 8, 2007, U.S. Patent Application Pub. No. US 2005/0223872, published Oct. 13, 2005, U.S. Design Pat. No. D454,149, issued Mar. 5, 2002, U.S. Design Pat. No. D448,400, issued Sep. 25, 2001, U.S. Design Pat. No. D395,330, issued Jun. 16, 1998, U.S. Design Pat. No. D369,615, issued May 7, 1996, U.S. Design Pat. No. D358, 833, issued May 30, 1995 and U.S. Design Pat. No. D356, 593, issued Mar. 21, 1995.

Some of the devices disclosed in the above-identified prior art utilize a plurality of jagged or serrated picking edges, while others employ a plurality of "fingers" which are utilized to strike only a single string, either in sequence or simultaneously. This approach severely limits tonal quality and does not begin to approximate the complex music produced by "finger plucking", that is, plucking of the strings by the player's fingers.

DISCLOSURE OF INVENTION

As will be described below in greater detail, the invention disclosed and claimed herein readily lends itself to simultaneously plucking a plurality of strings.

Furthermore, the prior art picks are generally relatively stiff, with any projections or fingers remaining fixed in position relative to one another and to the rest of the pick. In contrast, as will be described in greater detail below, the pick of this invention is manually bendable to provide various pick configurations during playing. This enables the player to obtain a wide variety of sounds and replicate techniques heretofore only obtainable by "finger picking."

In addition, dynamic range and volume are greatly increased through use of the present invention and a wide variety of guitar styles may be emulated. One can obtain a percussive, almost piano-like, effect. Prior art pick constructions do not have these capabilities. With the present invention, different chords and harmonics can be obtained and varied as the result of changing angles and orientations of the pick by simple wrist movement and the configuration of the device may be readily modified by bending and unbending the device by hand.

The present invention relates to a hand-held pick for playing guitars and other musical instruments having a plurality of strings. The hand-held pick includes an elongated pick body having a primary axis and a plurality of string engaging protrusions integral with the elongated pick body and extending outwardly from the elongated pick body in a direction generally orthogonal to the primary axis.

The protrusions are tapered, being defined by converging protrusion side walls and further defining notches between adjacent protrusions.

The hand-held pick in the absence of outside bending forces being applied thereto is in a first condition wherein the pick body and the protrusions are disposed in a common plane. The hand-held pick is flexible and bendable upon application of bending forces thereto to cause the hand-held pick to assume a second condition wherein the pick body forms a bend generally orthogonal to the primary axis with at least some of the protrusions displaced relative to one another and not disposed in a common plane.

The invention also encompasses a method of playing a guitar or other musical instrument having a plurality of strings, the strings being spaced from one another.

According to the method, a hand-held pick is provided, the hand-held pick including an elongated pick body having a primary axis and a plurality of string engaging protrusions integral with the pick body disposed along the elongated pick body and extending outwardly from the elongated pick body in a direction generally orthogonal to the primary axis.

The hand-held pick is positioned with the plurality of string engaging protrusions extending toward the strings of a musical instrument.

During playing of the musical instrument, at least two of the plurality of string engaging protrusions are utilized to simultaneously selectively engage and pluck a plurality of the strings.

The method also encompasses the step of bending the hand-held pick to form a bend in the pick body generally orthogonal to the primary axis with at least some of the string engaging protrusions displaced relative to one another and not disposed in a common plane.

Other features, advantages and objects of the present invention will become apparent with reference to the following description and accompanying drawings.

MODES FOR CARRYING OUT THE INVENTION

Figure 13:
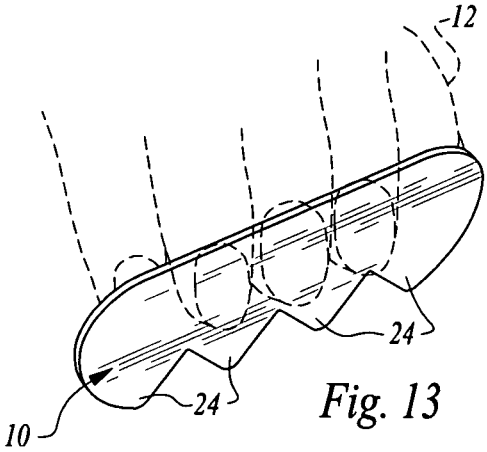
FIG. 13 is a perspective view of the first embodiment of the pick held by a user's hand, the pick being in an unbent condition with the pick body and string engaging protrusions thereof being disposed in a common plane.
Figure 14:
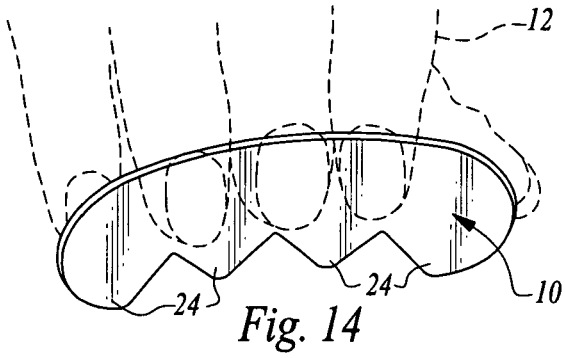
FIG. 14 is a perspective view of the hand-held pick of FIG. 13 being manually bent to provide a selected bent configuration.
Figure 15:
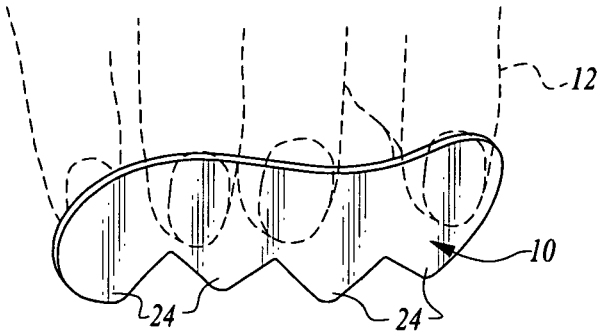
FIG. 15 is a view similar to FIG. 14, but illustrating the hand-held pick being manually bent to form an alternative bent configuration.
Figure 16:
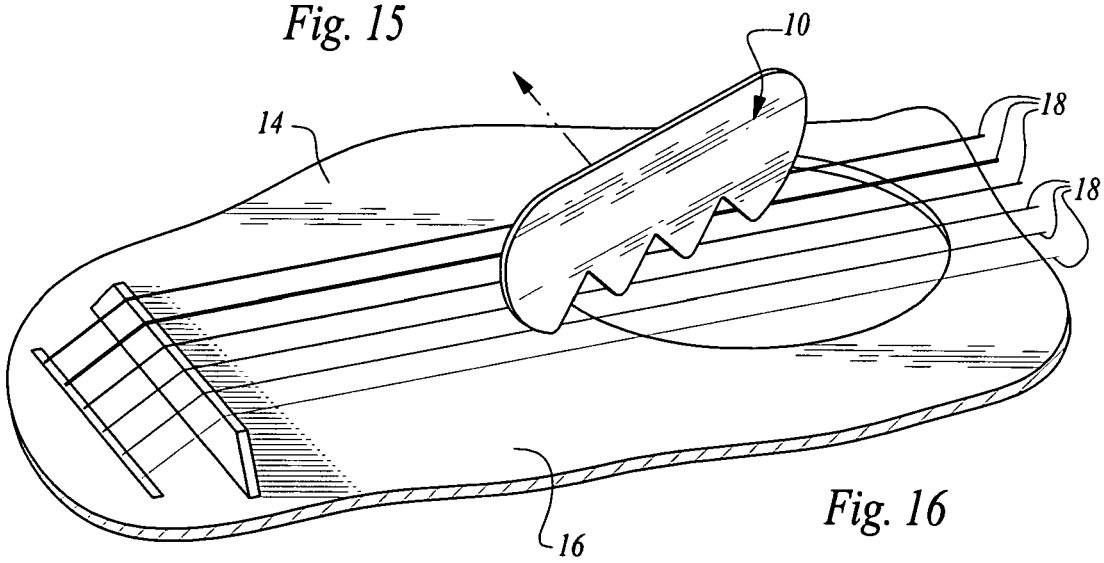
FIG. 16 is a perspective view illustrating the pick embodiment of FIG. 1 in unbent condition and moving in the direction of the illustrated arrow across strings of a guitar over the guitar body sound hole.
Figure 17:
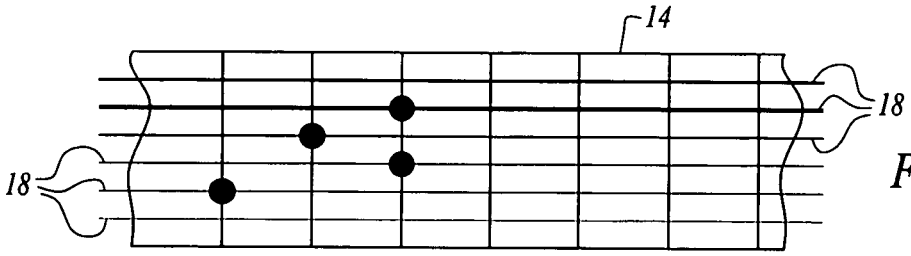
FIG. 17 is a top, plan view showing a portion of the guitar neck and strings and illustrating diagrammatically representative positioning of a user's fingers on the guitar strings of the neck when playing.
Figure 18:
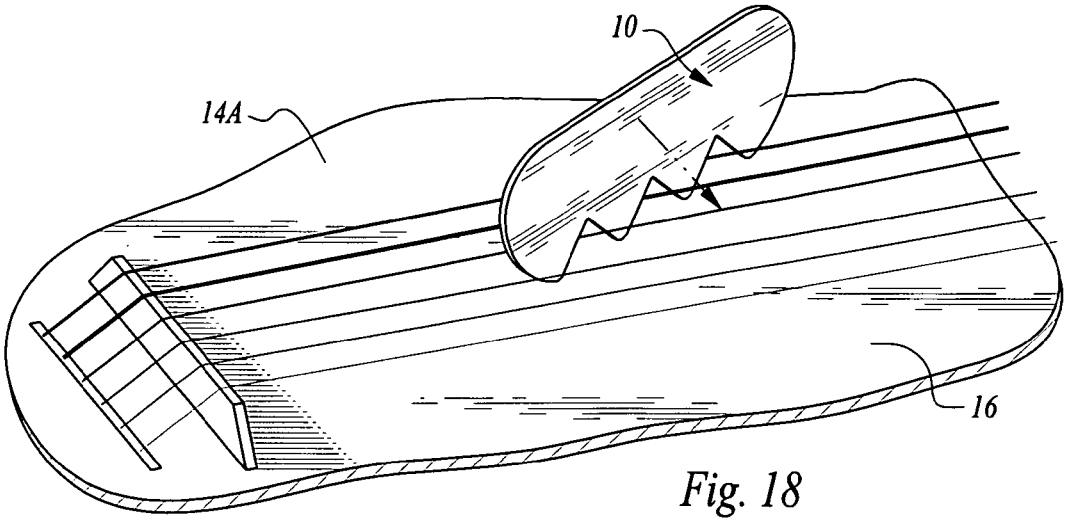
FIG. 18 is a view similar to FIG. 16, but illustrating the pick moving in the opposite direction over the strings of a guitar without a sound hole.

Referring now to FIGS. 1, 2 and 13-25, a preferred embodiment of a hand-held pick constructed in accordance with the teachings of the present invention is illustrated and identified by reference numeral 10. The hand-held pick is utilized for playing guitars and other musical instruments having a plurality of strings. FIGS. 13, 14 and 15, which will be discussed further below, show the pick 10 being held by a player's hand 12 illustrated by dash lines. FIGS. 16 and 18 respectively show the pick 10 in association with a guitar 14 with a sound hole and guitar 14A without a sound hole, the figures only illustrating a portion of the guitar body 16 and portions of guitar strings 18. As is conventional, the strings 18 are generally disposed in a common plane above the guitar body.

Figures 1, 2, 3, 4, 5, 6, 7, 8, 9, 10, 11, 12:
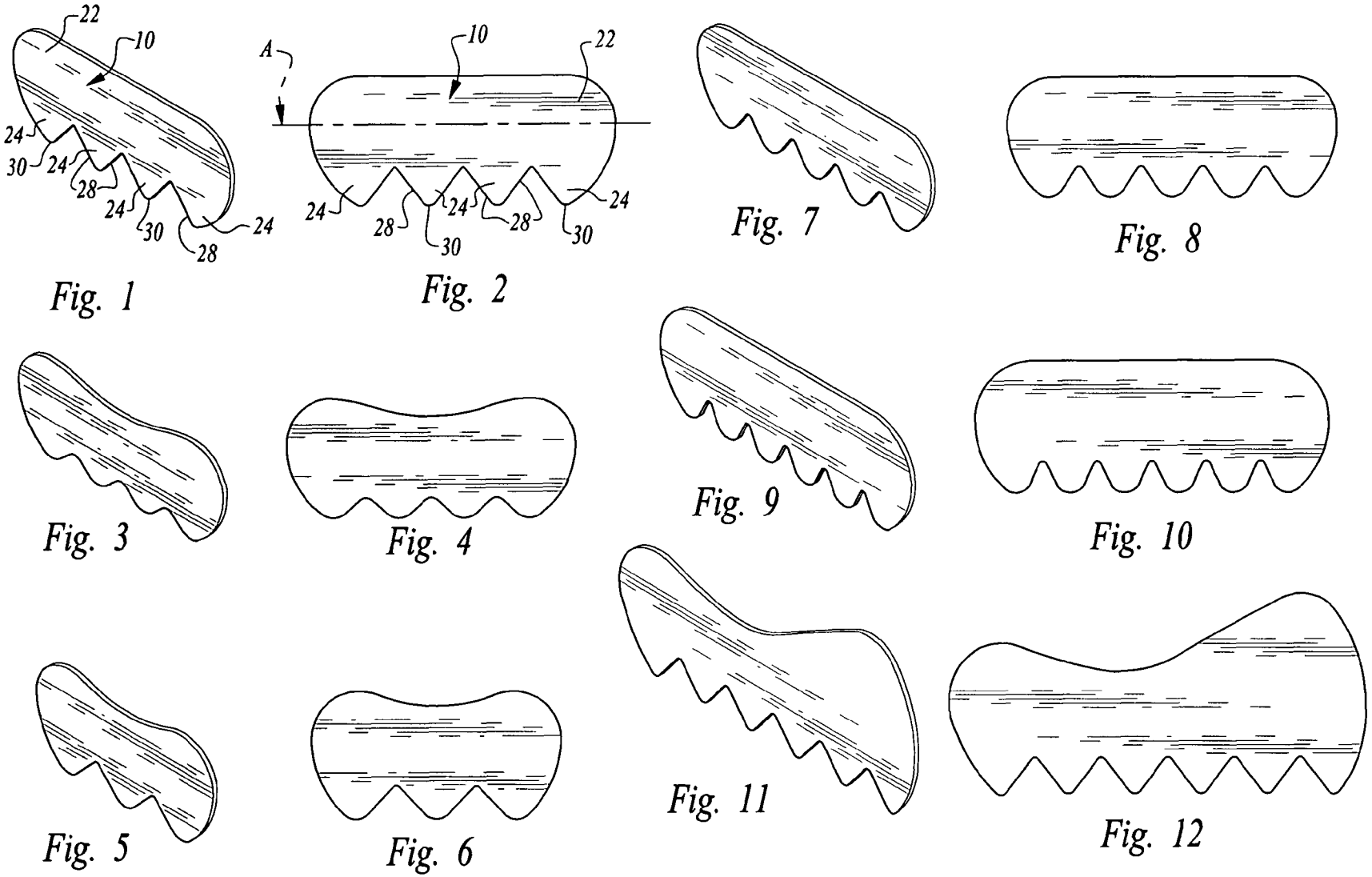
FIG. 1 is a perspective view of a first embodiment of pick constructed in accordance with the teachings of the present invention.
FIG. 2 is a front, elevation view of the pick of FIG. 1.
FIG. 3 is a perspective view of a second embodiment of pick.
FIG. 4 is a front, elevation view of the embodiment of FIG. 3.
FIG. 5 is a perspective view of a third embodiment of pick.
FIG. 6 is a front, elevation view of the pick of FIG. 5.
FIG. 7 is a perspective view of a fourth embodiment of pick.
FIG. 8 is a front, elevation view of the pick of FIG. 7.
FIG. 9 is a perspective view of a fifth embodiment of pick.
FIG. 10 is a front, elevation view of the pick of FIG. 9.
FIG. 11 is a perspective view of a sixth embodiment of pick.
FIG. 12 is a front, elevation view of the pick of FIG. 11.

Hand-held pick 10 includes an elongated pick body 22 having a primary axis A (see FIG. 2).

Pick 10 also includes four string engaging protrusions 24 integral with the elongated pick body and extending outwardly from the elongated pick body in a direction generally orthogonal to the primary axis A. Two protrusions 24 are disposed at the ends of the elongated pick body and hereinafter will be referred to as the endmost protrusions.

The protrusions 24 are tapered, being defined by converging protrusion sidewalls, the sidewalls further defining notches 28 between adjacent protrusions. The tapered protrusions have smoothly rounded tips 30 substantially equidistant from the primary axis A.

The hand-held pick 10 is of single-piece construction and is constructed of a material that is rigid enough to pluck strings but is flexible and bendable. A suitable material of such type is plastic sheet material. However, other suitable materials having the desired characteristics may be utilized. In a preferred form of the invention, the material has an elastic memory.

The hand-held pick 10 in the absence of outside bending forces being applied thereto is in a first condition wherein the elongated pick body 22 and the protrusions 24 are disposed in a common plane.

The hand-held pick is flexible and bendable upon application of bending forces thereto to cause the pick to assume a second condition wherein the pick body forms a bend generally orthogonal to the primary axis A with at least some of the protrusions 24 displaced relative to one another and not disposed in a common plane. Along with FIGS. 1 and 2, FIG. 13, among others, show the pick in the first condition. FIGS. 14 and 15 show the pick 10 in the second condition wherein a bend is formed. FIG. 14 illustrates in dash line a user's hand employed to bend the pick in one direction and FIG. 15 shows the user's hand bending the pick in the opposite direction.

If the pick is formed of material having an elastic memory, the pick returns to its first condition when outside bending forces are removed therefrom.

The guitar 14 or other stringed instrument can be played with the pick in either the first (straight) condition or in the second (bent) condition merely by changing the manual forces applied thereto during playing. The musician may make this change while actually playing to achieve different effects and results by changing string contact. Furthermore, the magnitude of the bend may be varied and the strings plucked differently during playing simply by varying the bending forces applied thereto. It will be appreciated that these capabilities provide a wide variety of musical effects, including those set forth above in the Disclosure of Invention section above.

FIG. 16 shows the pick 10 being swept across the strings 18 of guitar 14, the pick being shown in its first or straight condition. The tapered protrusion distal end portions 26 of the pick are spaced from one another distances enabling a plurality of the strings, which are generally disposed in a common plane, to be simultaneously engaged and plucked by all of the protrusions when the primary axis A is positioned generally parallel to the common plane occupied by the strings and the pick is laterally disposed relative to the strings, conditions illustrated in FIG. 16. FIG. 17 provides a representative diagrammatic illustration of finger locations of the player's hand that is not holding the pick along the neck of the guitar and strings on the neck.

FIG. 18 shows the hand-held pick 10 being swept in the opposite direction and, like the situation in FIG. 16, with all four protrusions 24 in simultaneous engagement with strings 18. In FIG. 18 the guitar 14A does not have a sound hole, being for example an electric guitar.

Figure 19:
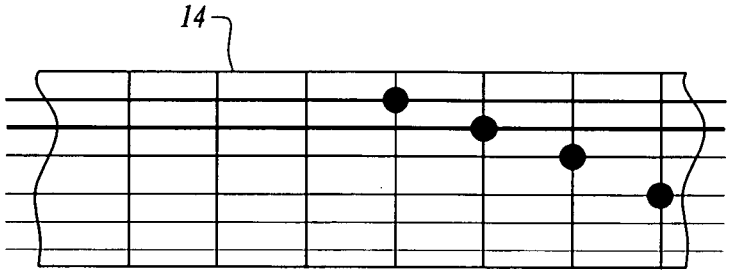
FIG. 19 is a view similar to FIG. 17, illustrating diagrammatically another representative example of finger placement on the strings on the neck while playing.

FIG. 19 is another diagrammatic illustration showing representative finger positioning on the strings at the neck of the guitar depicting fingers on all four strings engaged by the pick in the FIG. 18 illustration.

Figure 20:
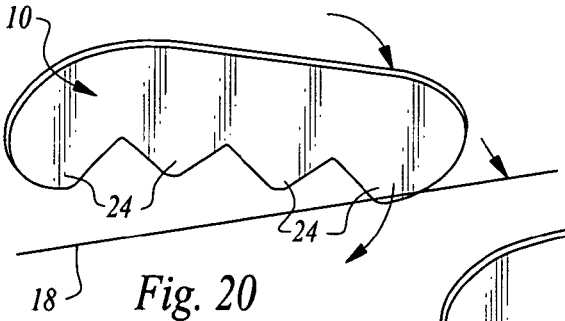
FIG. 20 is a perspective view illustrating the pick embodiment of FIG. 1 in unbent condition tilted or canted with an endmost protrusion of the pick initially engaging a single string.
Figure 21:
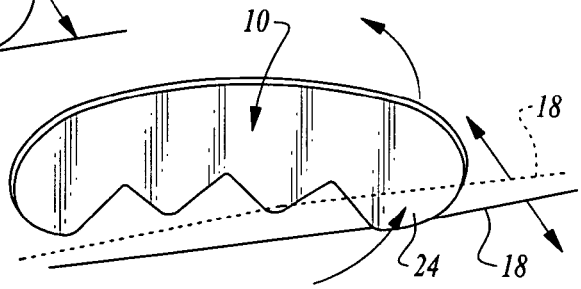
FIG. 21 is a view similar to FIG. 20, but showing the pick bent and releasing the string displaced by the single endmost protrusion during plucking.
Figure 22:
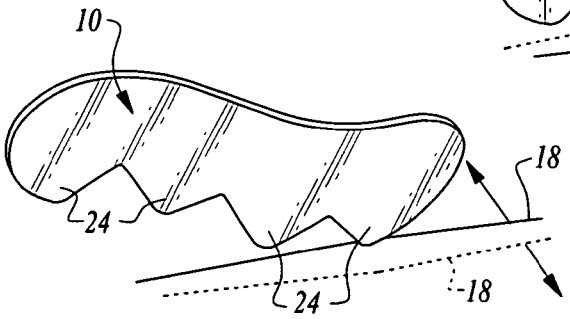
FIG. 22 is a perspective view of the first pick embodiment bent and canted relative to the single string after release of the string.
Figure 23:
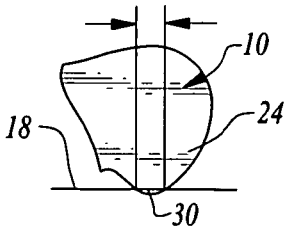
FIG. 23 is a diagrammatic view illustrating positioning of the endmost protrusion in the position illustrated in FIG. 20.
Figure 24:
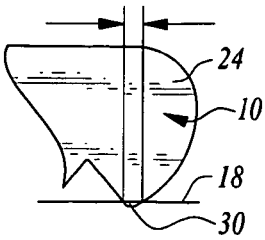
FIG. 24 is a view similar to FIG. 23, but illustrating the endmost protrusion with the string at the very tip thereof at the time of string release as shown in FIG. 21.

FIG. 20 shows pick 10 canted or tilted so that one of the endmost protrusions initially engages a single string 18. If single string picking is desired, this can be accomplished with a simple turn of the wrist. FIG. 23 shows the relationship between the endmost protrusion and the string at this stage wherein the area designated by the two arrows illustrates the contact area between the endmost protrusion and the string. FIG. 21 shows the string displaced by the pick being bent. As bending proceeds, the displaced string approaches the tip 30, and the contact between the pick and string diminishes (as shown in FIG. 24) and the string is released by slipping under the tip. FIG. 22 shows the string engaged by the opposed side of the endmost protrusion 34 and being displaced and plucked in the opposite direction.

It will be appreciated that a hand-held pick constructed in accordance with the teachings of the present invention may be of any suitable configuration. FIGS. 3 and 4 illustrate a second pick embodiment 10A. FIGS. 5 and 6 illustrate a third embodiment 10B. FIGS. 7 and 8 illustrate a fourth embodiment 10C. FIGS. 9 and 10 illustrate a fifth embodiment 10D. FIGS. 11 and 12 illustrate a sixth embodiment 10E.

The invention claimed is:

1. A method of playing a guitar or other musical instrument having a plurality of strings, said strings being spaced from one another, said method comprising, in combination, the steps of:

providing a hand-held pick including an elongated pick body having a primary axis and a plurality of string engaging protrusions integral with said pick body disposed along said elongated pick body and extending outwardly from said elongated pick body in a direction generally orthogonal to said primary axis;

positioning said hand-held pick with said plurality of string engaging protrusions extending toward the strings of a musical instrument; and during playing of the musical instrument, selectively simultaneously engaging and plucking a plurality of said strings with at least two of said plurality of string engaging protrusions and bending said hand-held pick to form a bend in said pick body generally orthogonal to said primary axis with at least some of said string engaging protrusions displaced relative to one another and not disposed in a common plane.

2. The method according to claim 1 wherein the step of bending the hand-held pick is accomplished by manually apply bending forces to said pick body during playing.

3. The method according to claim 2 wherein the magnitude of the bend is varied during playing by varying the bending forces applied thereto.

4. The method according to claim 2 wherein said hand-held pick is formed of material having an elastic memory, said method including the step of employing said elastic memory to return the hand-held pick to a condition wherein said elongated pick body and the string engaging protrusions are disposed in a common plane after removing said bending forces from the pick body.

5. The method according to claim 1 wherein said hand-held pick when used to simultaneously engage and pluck a plurality of said strings with at least two of said plurality of said string engaging protrusions is positioned with said primary axis generally parallel to a common plane occupied by said strings and laterally disposed relative to said strings.

6. The method according to claim 1 wherein said string engaging protrusions have rounded tips substantially equidistant from said primary axis.

7. The method according to claim 1 wherein said string engaging protrusions include two endmost, string engagement protrusions, said method including, during playing, the step of individually selectively alternatively engaging said endmost string engagement protrusions with a preselected single string to pluck said preselected single string.

8. The method according to claim 7 wherein said hand-held pick is canted during playing to position said primary axis at an angle relative to a common plane occupied by said strings when plucking said single string.

* * * * *